US006043803A

United States Patent [19]

Shimizu

[11] Patent Number: 6,043,803

[45] Date of Patent: Mar. 28, 2000

[54] ADJUSTMENT OF FREQUENCY OF DOT CLOCK SIGNAL IN LIQUID

[75] Inventor: Takashi Shimizu, Tokyo, Japan

[73] Assignee: NEC Corporation, Japan

[21] Appl. No.: 08/932,278

[22] Filed: Sep. 17, 1997

[30] Foreign Application Priority Data

Sep. 18, 1996 [JP] Japan ..... 8-267828

[51] Int. Cl.[7] ..... G09G 5/00

[52] U.S. Cl. ..... 345/132; 345/213

[58] Field of Search ..... 345/211, 213, 345/132, 127, 204, 3, 212; 348/500, 537, 536, 547

[56] References Cited

U.S. PATENT DOCUMENTS 5,406,308 4/1995 Shiki ..... 345/127
5,579,029 11/1996 Arai et al. ..... 345/132
5,592,187 1/1997 Zenda ..... 345/3

*Primary Examiner*—Richard A. Hjerpe
*Assistant Examiner*—Francis Nguyen
*Attorney, Agent, or Firm*—Ostrolenk, Faber, Gerb & Soffen, LLP

[57] ABSTRACT

In a liquid crystal display apparatus connected to a computer, a screen size detecting section detects screen size data indicating a size for one screen from a horizontal sync signal, a vertical sync signal, an image data signal and a dot clock signal. The horizontal sync signal, the vertical sync signal and the image data signal are supplied from a computer. A dot clock signal generating circuit generates the dot clock signal from the horizontal sync signal. A control section controls the dot clock signal generating circuit to generate the dot clock signal having a target frequency based on the detected screen size data, the horizontal sync signal and the vertical sync signal, such that the dot clock is adaptive for the computer. A display section including a liquid crystal display unit, displays the image data signal on the liquid crystal display unit in response to the dot clock signal having the target frequency.

24 Claims, 7 Drawing Sheets

ADJUSTMENT OF FREQUENCY OF DOT CLOCK SIGNAL IN LIQUID

BACKGROUND OF THE INVENTION

1. Field of the Invention

The present invention relates to a liquid crystal display apparatus which can be connected to a computer in place of a cathode ray tube display apparatus. More particularly, the present invention relates to a liquid crystal display apparatus having a function to automatically adjust a frequency of a dot clock signal reproduced on the side of the liquid crystal display apparatus to an optimal value to fit to the frequency of a dot clock signal in a cathode ray tube display apparatus.

2. Description of the Related Art

Generally, a horizontal sync signal, a vertical sync signal and analog image signals R, G, B are inputted from a computer or a workstation to a display apparatus. The frequency of a dot clock signal in the computer and the workstation as an image signal source depends on the model and resolution of the image signal source. The relation of the dot clock signal frequency and the mode and resolution is shown in the following table 1.

TABLE 1

| model | resolution | horizontal frequency (KHz) | vertical frequency (Hz) | dot clock frequency (MHz) |
|---|---|---|---|---|
| A | 600 × 400 | 24.827 | 56.424 | 21.053 |
| B | 640 × 480 | 31.469 | 70.087 | 28.322 |
| C | 832 × 624 | 31.469 | 74.000 | 57.283 |

FIG. 1 is a block diagram illustrating the structure of a conventional liquid crystal display apparatus to which a computer is connected. In the conventional liquid crystal display apparatus, a microcomputer 35 measures a horizontal sync signal and a vertical sync signal during a predetermined time period and calculates the frequency of the horizontal sync signal and the frequency of the vertical sync signal based on the measuring result. Then, the microcomputer 35 estimates the model of the computer from the calculating result using a table 36 like the table 1. Consequently, the microcomputer 35 controls a phase locked loop (PLL) circuit 34 based on a dot clock value for the estimated computer such that a dot clock signal corresponding to the computer is reproduced. An A/D converter 31 samples an image signal in accordance with the dot clock signal reproduced by the PLL circuit 34 and converts into a digital signal. A data processing circuit 32 adjusts timing and so on such that the image signal converted into the digital signal can be displayed on a liquid crystal display unit 33.

However, there is a case where the reproduced dot clock signal is subtly different from the dot clock signal used in a computer, depending on the model and resolution of the computer. In such a case, a user conventionally adjusts the frequency of the dot clock signal using switches and so on such that blur, color deviation, fluctuation and so on can be eliminated, while confirming a display by the eyes.

There is known a liquid crystal display apparatus disclosed in Japanese Laid Open Patent Disclosure (JP-A-Heisei 7-160222) in which the above adjustment is automated. In this apparatus, a specific image signal for the adjustment is inputted from a computer. While the frequency of the dot clock signal is changed, whether or not an image data is correctly A/D-converted is determined in units of dots during one horizontal period. When all the A/D-converted data become correct, the correct dot clock state is established.

As mentioned above, in the conventional liquid crystal display apparatuses, when the image signal sources such as the computer and the liquid crystal display apparatus are subtly different from each other in the frequency of the dot clock signal, the frequency of the dot clock signal on the side of the liquid crystal display apparatus has been manually adjusted such that the blur and fluctuation can be eliminated.

Also, in the liquid crystal display apparatus disclosed in Japanese Laid Open Patent Disclosure (JP-A-Heisei 7-160222), the automatic adjustment is accomplished. In this case, however, it is required that the computer outputs the specific image signal for the adjustment.

SUMMARY OF THE INVENTION

Therefore, the present invention is accomplished to solve such problems. An object of the present invention is to provide a liquid crystal display apparatus in which the frequency of a dot clock signal can be automatically adjusted without using a specific image signal for the adjustment, when the liquid crystal display apparatus is connected to a computer to display an image signal.

Another object of the present invention is to provide a method of automatically adjusting the frequency of a dot clock signal without using a specific image signal for the adjustment, when the liquid crystal display apparatus is connected to a computer to display an image signal.

In order to achieve an aspect of the present invention, a liquid crystal display apparatus connected to a computer includes a screen size detecting section for detecting a screen size data indicating a size for one screen from a horizontal sync signal, a vertical sync signal, an image data signal and a dot clock signal, wherein the horizontal sync signal, the vertical sync signal and the image data signal are supplied from a computer, a dot clock signal generating circuit for generating the dot clock signal from the horizontal sync signal, a control section for controlling the dot clock signal generating circuit to generate the dot clock signal having a target frequency based on the detected screen size data, the horizontal sync signal and the vertical sync signal, such that the dot clock is adaptive for the computer, and a display section including a liquid crystal display unit, for displaying the image data signal on the liquid crystal display unit in response to the dot clock signal having the target frequency.

The control section may include a first section for monitoring the horizontal sync signal and the vertical sync signal to generate a first control data, and a second section for generating a second control data based on the screen size data and the first control data. In this case, the dot clock signal generating circuit generates the dot clock signal having a first frequency based on the first control data and generates the dot clock signal having a second frequency as the target frequency based on the second control data. In other words, the first section includes a table for storing a plurality of data sets, each of which represents a relation of a horizontal sync signal frequency, a vertical sync signal frequency, a target dot clock signal frequency and a target resolution, and a section for measuring the horizontal sync signal frequency and the vertical sync signal frequency, for referring to the table based on the measured horizontal sync signal frequency and the measured vertical sync signal frequency, and for outputting the first control data corresponding to the target dot clock signal frequency to the dot clock signal generating circuit based on the referring result. In this case, the second section further includes: a section for calculating a ratio of the target resolution to the screen size data to output, as the second control data, a data obtained by multiplying the calculating result by the first control data.

Alternatively, the control section may include a control data generating section for monitoring the horizontal sync signal and the vertical sync signal, and for generating a control data based on the screen size data and the monitoring result. In this case, the dot clock signal generating circuit generates the dot clock signal having the target frequency based on the control data. In other words, the control data generating section includes a table for storing a plurality of model data each of which represents a relation of a horizontal sync signal frequency, a vertical sync signal frequency, a target dot clock signal frequency and a target resolution, and a section for measuring the horizontal sync signal frequency and the vertical sync signal frequency, for referring to the table based on the measured horizontal sync signal frequency and the measured vertical sync signal frequency to obtain the target dot clock signal frequency and the target resolution, for calculating a ratio of the target resolution to the screen size data, and for outputting, as the control data, a data obtained by multiplying the calculating result by the target dot clock signal frequency.

The screen size detecting section includes a counter for counting dot clocks of the dot clock signal for every horizontal scan line, a signal level comparator for comparing the image data signal and a reference signal level, a display start position detecting circuit for detecting a dot clock count of the counter corresponding to a display start position for every horizontal scan line based on the comparing result, a display end position detecting circuit for detecting a dot clock count of the counter corresponding to a display end position for every horizontal scan line based on the comparing result, a minimum value detecting section for detecting a minimum value of the dot clock counts corresponding to the display start positions for the respective horizontal scan lines for one screen, a maximum value detecting section for detecting a maximum value of the dot clock counts corresponding to the display end positions for the respective horizontal scan lines for the one screen, and an output section for outputting the minimum value and the maximum value as the screen size data to the control section.

In order to achieve another aspect of the present invention, a method of display an image data signal in a liquid crystal display apparatus connected to a computer includes the steps:

receiving a horizontal sync signal, a vertical sync signal and an image data signal from a computer;

generating a dot clock signal from the horizontal sync signal;

detecting a screen size data indicating a size for one screen from the horizontal sync signal, a vertical sync signal, an image data signal and a dot clock signal;

changing a frequency of the dot clock signal based on the detected screen size data, the horizontal sync signal and the vertical sync signal; and displaying the image data signal on a liquid crystal display unit in response to the dot clock signal having the target frequency.

In order to achieve still another aspect of the present invention, a liquid crystal display apparatus connected to a computer includes a screen size detecting section for detecting a screen size data indicating a size for one screen from a horizontal sync signal, a vertical sync signal, an image data signal and a dot clock signal, wherein the horizontal sync signal, the vertical sync signal and the image data signal are supplied from a computer, a PLL circuit for generating the dot clock signal from the horizontal sync signal based on a frequency division control data, a control section for monitoring the horizontal sync signal and the vertical sync signal to generate a first control data as the frequency division control data to the PLL circuit, and for generating a second control data as the frequency division control data to the PLL circuit based on the screen size data, and a display section including a liquid crystal display unit, for displaying the image data signal on the liquid crystal display unit in response to the dot clock signal having a target frequency.

DESCRIPTION OF THE PREFERRED EMBODIMENTS

Next, a liquid crystal display apparatus of the present invention will be described below in detail with reference to the accompanying drawings.

Figure 1:
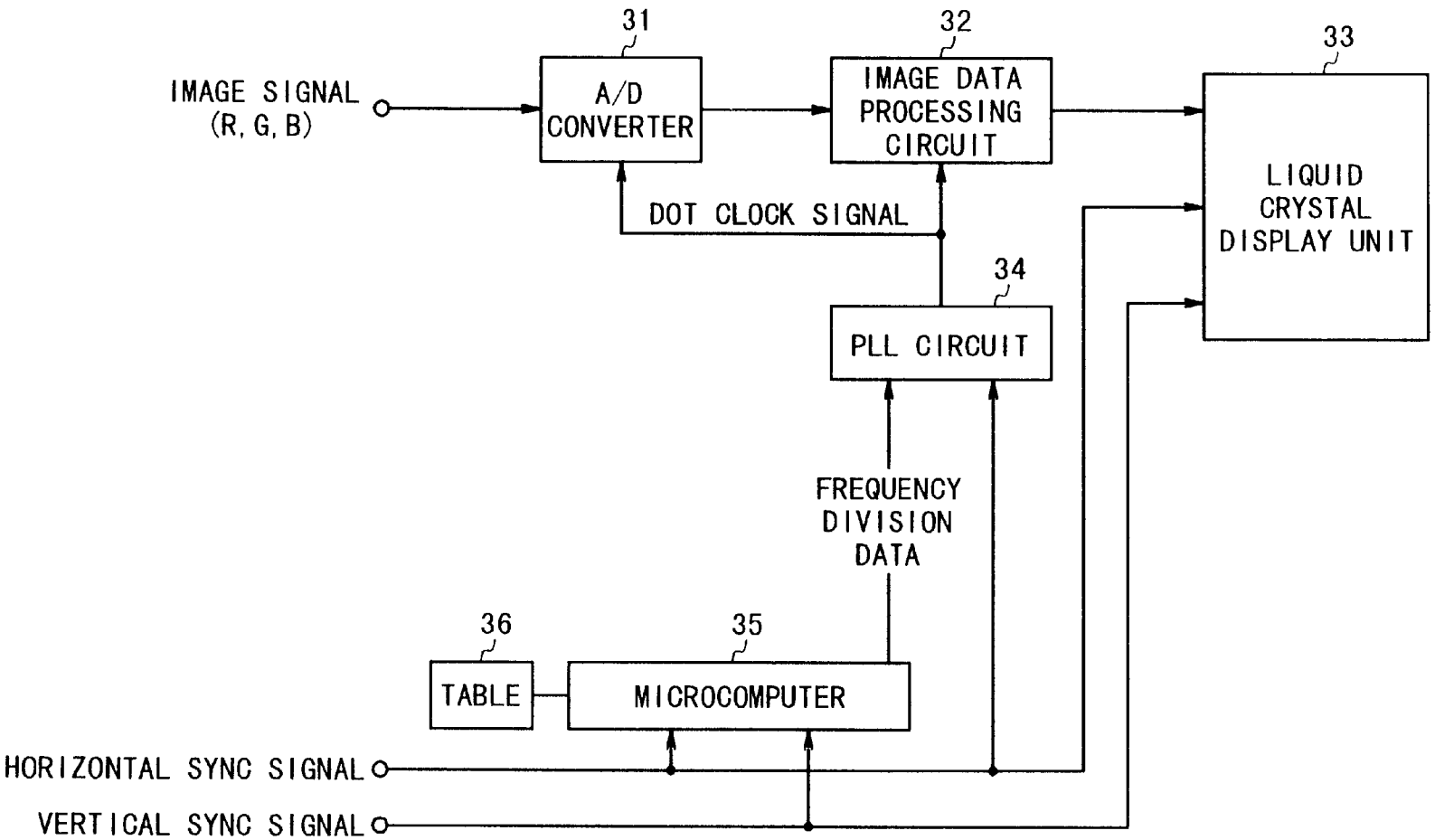
Fig. 1 PRIOR ART
FIG. 1 is a block diagram illustrating the structure of a conventional the liquid crystal display apparatus.
Figure 2:
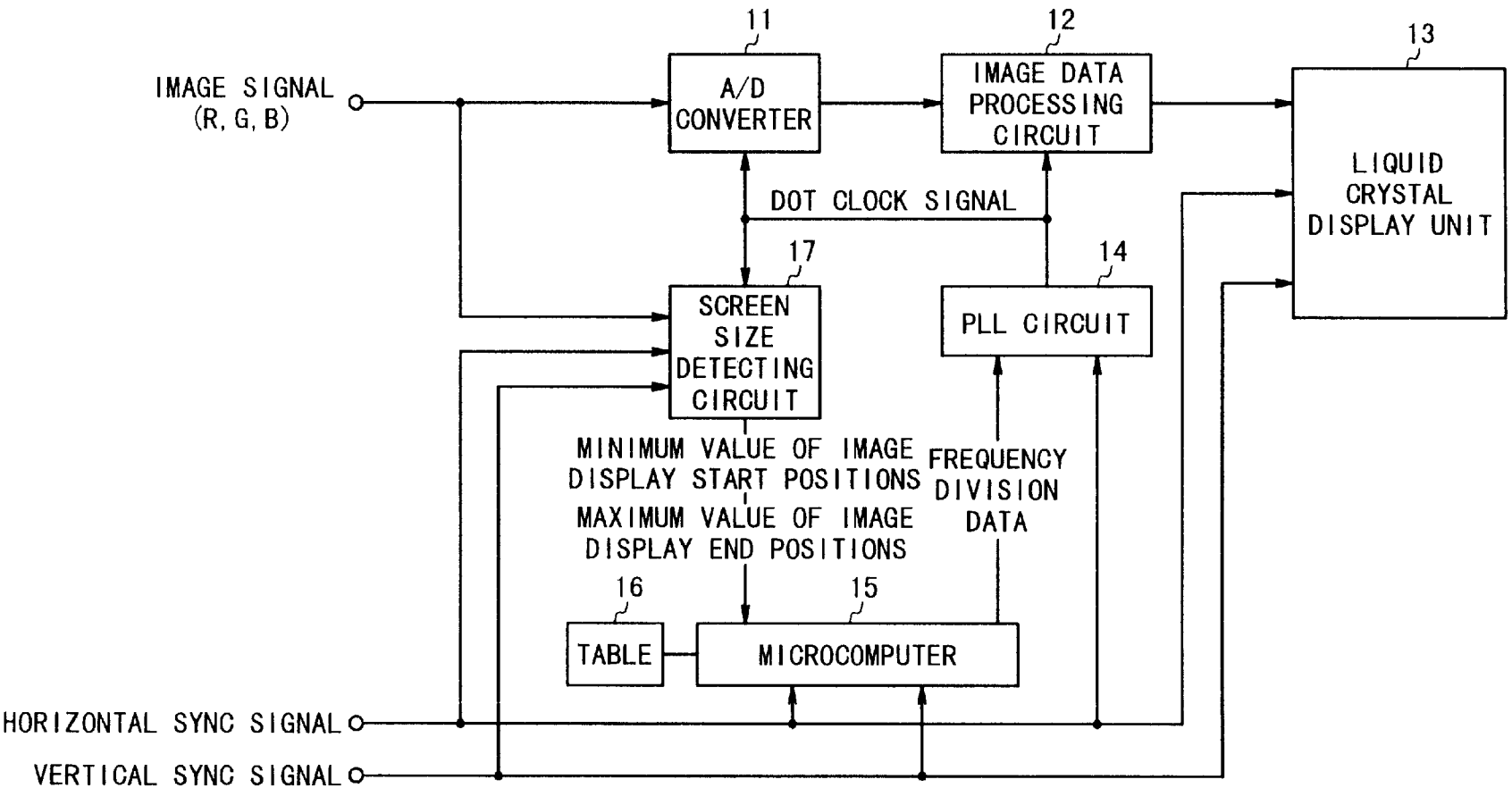
FIG. 2 is a block diagram illustrating the structure of a liquid crystal display apparatus according to a first embodiment of the present invention.

FIG. 2 is a block diagram illustrating the structure of the liquid crystal display apparatus according to the first embodiment of the present invention. Referring to FIG. 2, the liquid crystal display apparatus is composed of an A/D converter 11, an image processing circuit 12, a liquid crystal display unit 13, a PLL circuit 14, a microcomputer 15, a table 16 and a screen size detecting circuit 17.

First, the microcomputer 15 measures a horizontal sync signal and a vertical sync signal during a predetermined time period, e.g., one screen and calculates the frequency of the horizontal sync signal and the frequency of the vertical sync signal. The table 16 stores the contents similar to the above Table 1 for various computers. The microcomputer 15 refers to the table 16 to estimate the model of a signal source, i.e., a computer connected to the liquid crystal display apparatus. Then, the microcomputer 15 outputs frequency division control data which is determined based on the resolution of the signal source to the PLL circuit 14. The PLL circuit 14 receives the horizontal sync signal to generate a dot clock signal based on the frequency division control data such that the dot clock signal is adaptive for the computer. In this manner, the PLL circuit 14 generates the dot clock signal from the horizontal sync signal based on the control data.

Using the dot clock signal generated from the PLL circuit 14, the screen size detecting circuit 17 detects the clocks during an effectively displayable signal period of the horizontal image signal period. The screen size detecting circuit 17 outputs the minimum value of the image display start positions and the maximum value of the image display end positions for one screen, to the microcomputer, 15 as screen size data based on the detecting results.

The microcomputer 15 subtracts the minimum value of the image display start positions from the maximum of the image display end positions to calculate an effective screen size in the horizontal direction, namely, a horizontal resolution. The microcomputer 15 compares the calculated horizontal resolution and the horizontal resolution of the signal source previously estimated from the horizontal sync signal and the vertical sync signal to determine a new frequency division control data. Then, the microcomputer 15 outputs the new frequency division control data to control the PLL circuit to adjust the frequency of the dot clock signal such that an error between both the horizontal resolutions is eliminated.

After the frequency of the dot clock signal is adjusted to a proper value, the A/D converter 11 samples an image signal in accordance with the dot clock signal reproduced by the PLL circuit 14 and converts into a digital image signal, like the conventional example. The data processing circuit 12 adjusts timing and so on such that the digital image signal can be displayed on the liquid crystal display unit 13.

Figure 3:
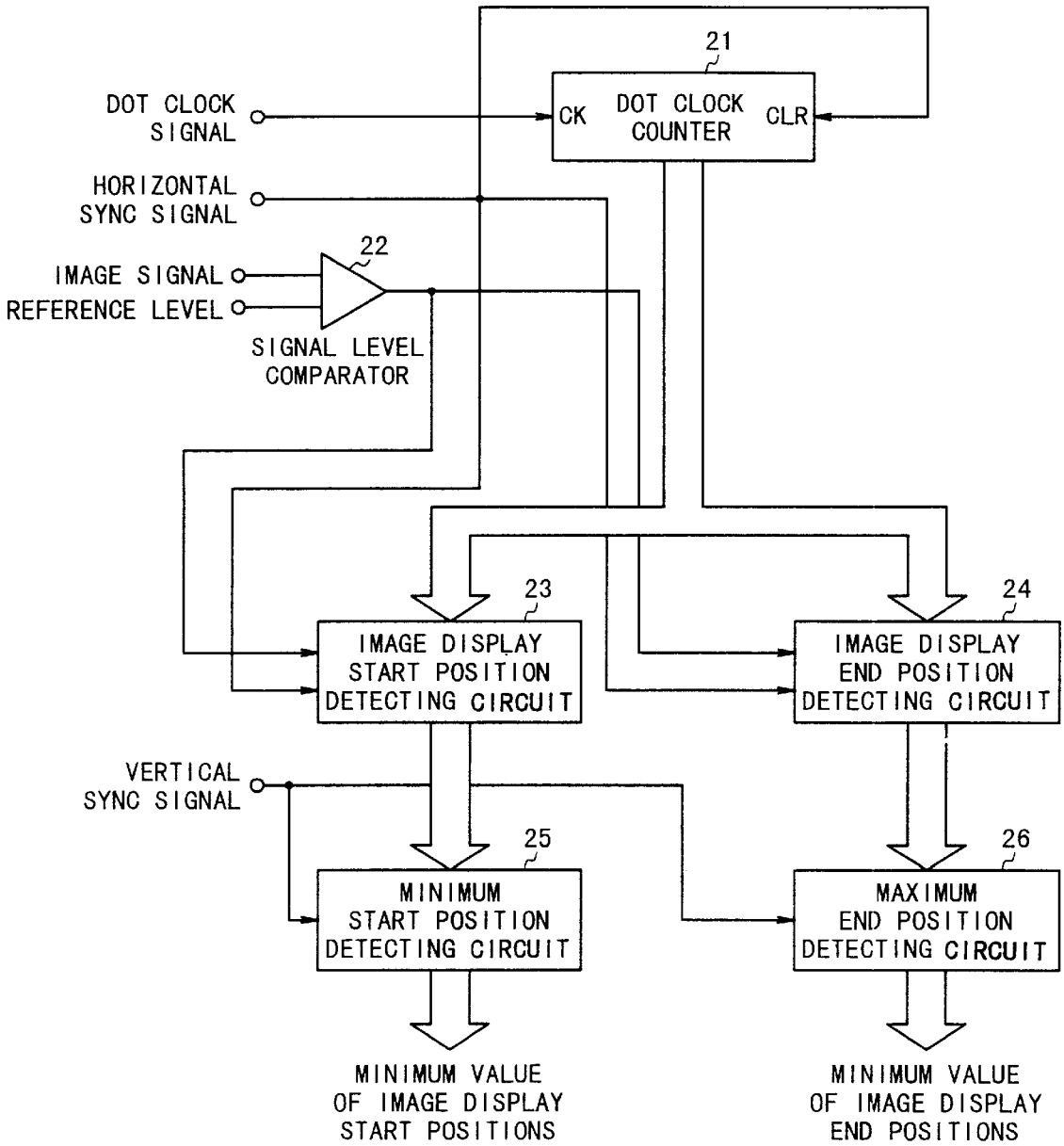
FIG. 3 is a block diagram illustrating the structure of a screen size detecting circuit shown in FIG. 2.

FIG. 3 is a block diagram illustrating the structure of the screen size detecting circuit 17. Referring to FIG. 3, the screen size detecting circuit 16 is composed of a dot clock signal counter 21, a signal level comparing circuit 22, an image display start position detecting circuit 23, an image display end position detecting circuit 24, a minimum start position detecting circuit 25, and a maximum end position detecting circuit 26.

The dot clock signal counter 21 is cleared in response to input of the horizontal sync signal and always counts dot clocks of the dot clock signal otherwise. The signal level comparing circuit 22 always compares an analog image signal with a predetermined reference level which is at a level when no signal is inputted. The signal level comparing circuit 22 outputs a signal of a high level when the image signal is higher than the reference level, i.e., when the image signal to be displayed is inputted. Also, the signal level comparing circuit 22 outputs the signal of a low level, when the image signal is lower than the reference level, i.e., when the image signal to be displayed is not inputted.

After the horizontal sync signal is inputted, the image display start position detecting circuit 23 latches the count value of the dot clock signal counter 21 when the output signal of the signal level comparing circuit 22 first changes from the low level to the high level. That is, the image display start position detecting circuit 23 latches the count value of the dot clock signal counter 21 in the image display start position during one horizontal period.

After the horizontal sync signal is inputted, the image display end position detecting circuit 24 latches the count value of the dot clock signal counter 21 when the output signal of the signal level comparing circuit 22 changes from the high level to the low level immediately before the next horizontal sync signal is inputted. That is, the image display end position detecting circuit 24 latches the count value of the dot clock signal counter 21 in the image display end position during one horizontal period.

The minimum start position detecting circuit 25 detects the smallest value of the image display start positions detected for respective horizontal periods during one vertical period. The minimum start position detecting circuit 25 outputs the detected smallest value as the minimum value of the image display start positions. The maximum end position detecting circuit 26 detects the largest value of the image display end positions detected for respective horizontal periods during one vertical period. The maximum end position detecting circuit 26 outputs the largest value as the maximum value of the image display end positions.

The value obtained by subtracting the minimum value of the image display start positions from the maximum value of the image display end positions is set as the screen size of the horizontal direction.

Figure 4:
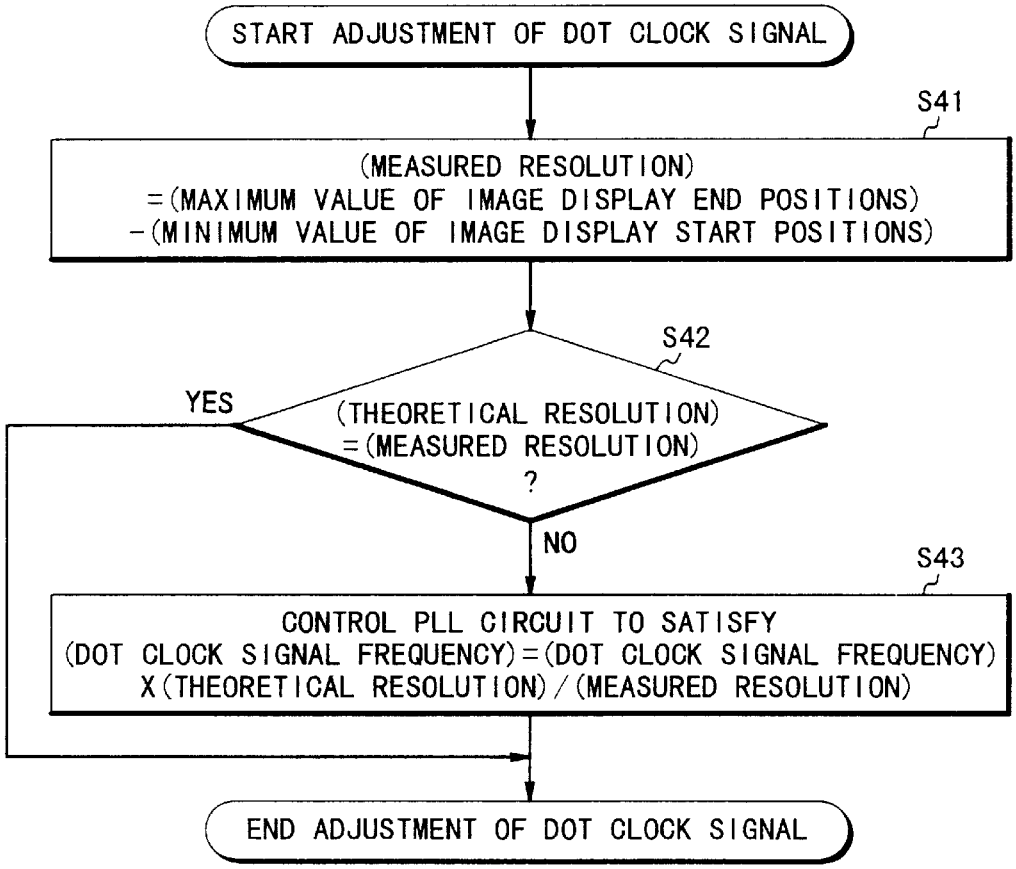
FIG. 4 is a flow chart to explain the operation of a microcomputer in adjustment of a dot clock signal.

Next, the operation of the liquid crystal display apparatus by the embodiment of the present invention will be described. FIG. 4 is a flow chart illustrating the processing of the microcomputer 15 in adjustment of the dot clock signal.

First, in a step S41, the microcomputer 15 subtracts the minimum value of the image display start positions from the maximum of the image display end positions and sets the result as a measured resolution.

Next, in a step S42, the horizontal resolution of the signal source which has been estimated by referring to the table 16 based on the horizontal sync signal and the vertical sync signal is set as a theoretical resolution. The measured resolution and theoretical resolution are compared. If both are coincident with each other, the processing ends. If both are not coincident with each other, a step S43 is executed.

In the step S43, the frequency of the dot clock signal is adjusted based on the ratio of the theoretical resolution to the measured resolution. For example, the theoretical resolution of the horizontal sync signal of the signal source which has been estimated from the vertical sync signal is assumed to be 640 dots. In this case, the frequency of the dot clock signal is assumed to be 31.5 MHz. Also, it is assumed that the maximum value of the image display end positions is 800 and the minimum value of the image display start positions is 156. In this case, the measured resolution is 644 dots. Because the frequency of the dot clock signal is too high, the number of dots of the effective image data which should be 640 dots originally is measured as the 644 dots. In accordance with, the frequency of the dot clock signal should be lowered.

A new frequency of the dot clock signal is calculated in accordance with the following equation.

(the new frequency of the dot clock signal)=(the current frequency of the dot clock signal)×(the theoretical resolution)/(the measured resolution)

The microcomputer 15 determines a new frequency division control data based on the determined new frequency of the dot clock signal to output to the PLL circuit 14. In this example, the PLL circuit 14 is controlled to generate the dot clock signal having the following frequency from the above-mentioned equation.

$$31.5\times(640/644)=31.3\ \text{MHz}$$

Figure 5:
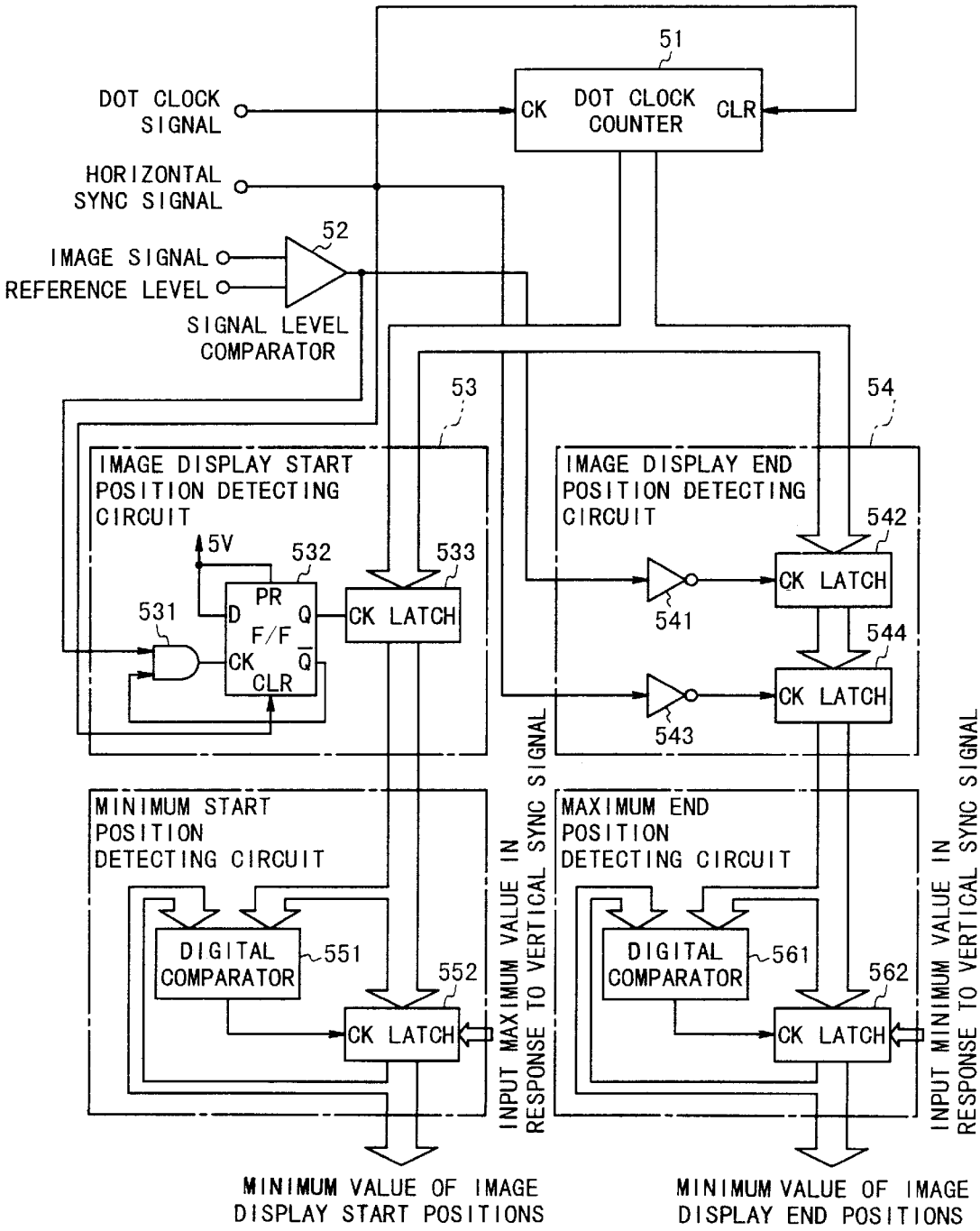
FIG. 5 is a block diagram illustrating the structure of the screen size detecting circuit shown in FIG. 2 in detail.

Next, the screen size detecting circuit 17 will be described in detail. FIG. 5 is a block diagram illustrating the more detailed structure of the screen size detecting circuit 17. FIGS. 6A to 6G are waveform diagrams illustrating the waveforms of various signals of the screen size detecting circuit 17.

Figure 6:
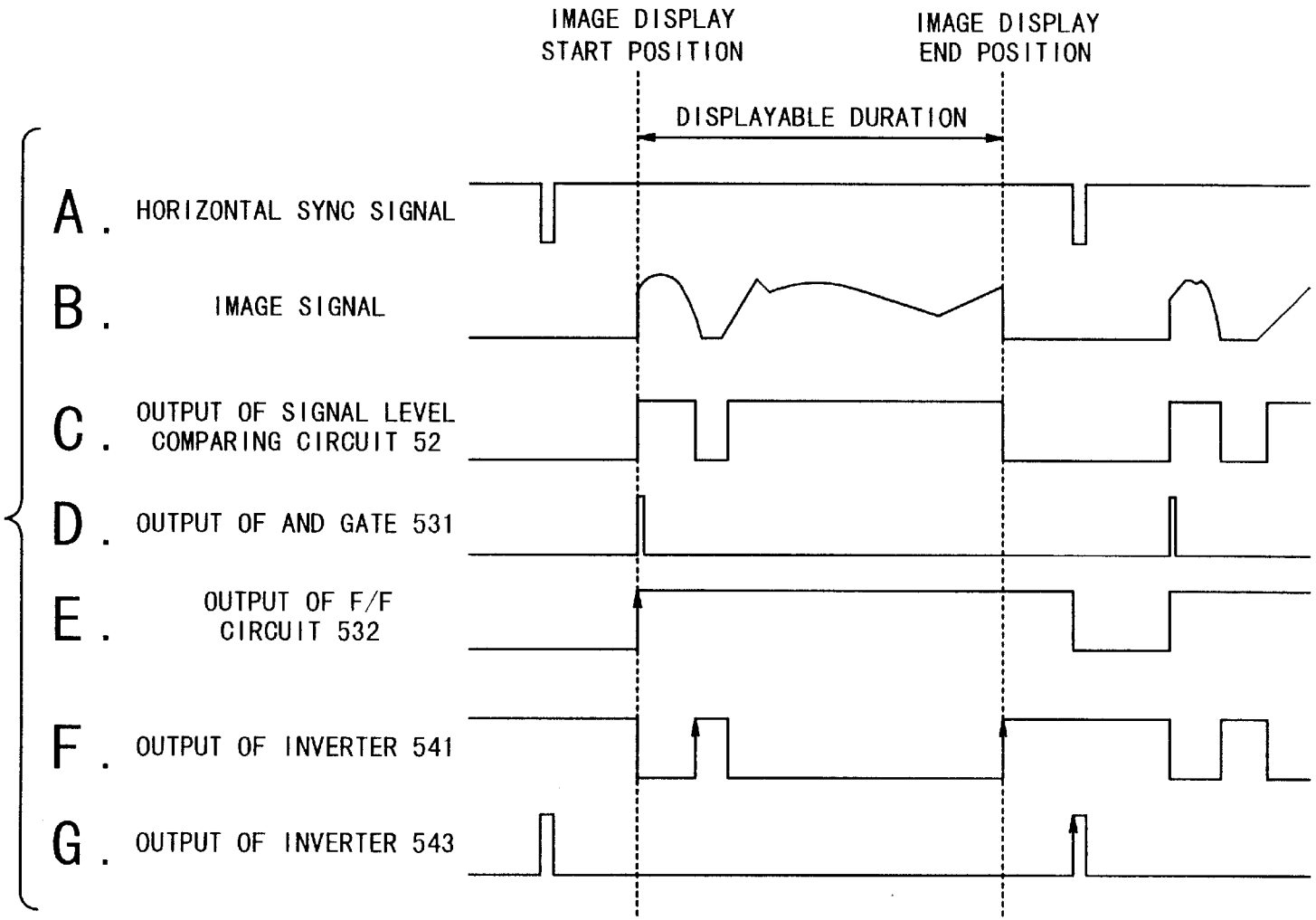
FIGS. 6A to 6G are waveform diagrams to explain the operation of the screen size detecting circuit.

When the horizontal sync signal and the image signal are inputted as shown in FIGS. 6A and 6B, a dot clock signal counter 51 is cleared in the period which the horizontal sync signal has the low level. The dot clock signal counter 51 counts dot clocks of the dot clock signal during the period when the horizontal sync signal is in the high level.

Also, a signal level comparing circuit 52 compares the image signal and a reference level and outputs the signal having the low level when the image signal is lower than the reference level and having the high level when the image signal is higher than the reference level, as shown in FIG. 6C.

At this time, an AND circuit 531 and a flip-flop (F/F) circuit 532 output signals as shown in FIGS. 6D and 6E, respectively. In accordance therewith, a latch circuit 533 latches the value of the dot clock signal counter 51 as the image display start position at the rising edge of the output signal of the flip-flop circuit 532. An inverter circuit 541 inverts the output signal of the signal level comparing circuit 52 and outputs the signal shown in FIG. 6F. Also, an inverter circuit 543 inverts the horizontal sync signal and outputs the signal shown in FIG. 6G. A latch circuit 542 latches the value of the dot clock signal counter 51 at the rising edge of the output signal from the inverter 541. A latch circuit 544 latches the value of latch circuit 542 at the rising edge of the output signal of the inverter 543. In accordance therewith, the value of the dot clock signal counter 51 as the image display end position is latched by the latch circuit 544.

A digital comparator 551 compares the image display start position inputted from the latch circuit 533 for every horizontal period and the latched value of the latch circuit 552. The latched value of the latch circuit 552 is maintained when the latched value of the latch circuit 552 is smaller than the inputted image display start position. On the other hand, when the latched value of the latch circuit 552 is larger than the inputted image display start position, the digital comparator 551 outputs a clock trigger. When the clock trigger is outputted from the digital comparator 551, the latch circuit 552 latches the latched value of the latch circuit 533. In this manner, the minimum value of the image display start positions is latched by the latch 552 by repeating the above processing during one vertical sync period.

A digital comparator 561 compares the image display end position inputted from a latch circuit 544 for every horizontal sync period and the latched value of a latch circuit 562. The digital comparator 561 outputs a clock trigger when the latched value of latch circuit 562 is smaller than the inputted image display end position. A minimum value is previously set to the latch circuit 562 in response to the vertical sync period. When the clock trigger is outputted from the digital comparator 561, the latch circuit 562 latches the latched value of the latch circuit 544. On the other hand, when the latched value of latch circuit 562 is larger than the inputted the image display end position, the latch circuit 562 maintains the latched value. In this manner, the maximum value of the image display end positions is maintained by the latch circuit 562 by repeating the above processing during one vertical sync period.

In the above description, the frequency division control data is set to the PLL circuit 14 twice to adjust the frequency of the dot clock signal. A temporary frequency is set in response to the first frequency division control data which is determined by referring to the table 16 based on the monitoring of the horizontal sync signal and the vertical sync signal. Then, a target frequency of the dot clock signal is set in response to the second frequency division control data which is determined based on the detected screen size (the measured resolution) and the theoretical resolution obtained in the reference to the table 16.

Figure 7:
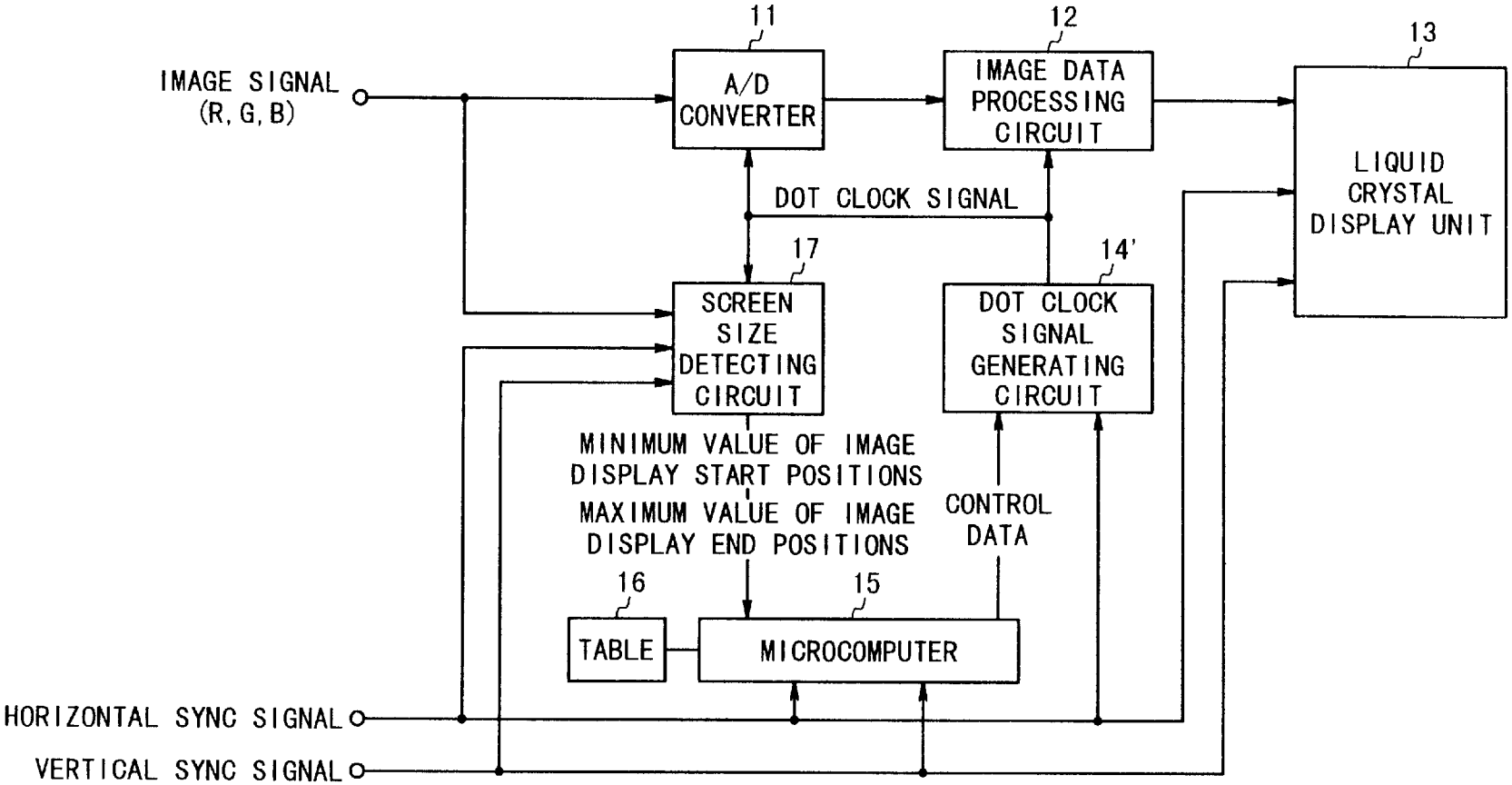
FIG. 7 is a block diagram illustrating the structure of a liquid crystal display apparatus according to a second embodiment of the present invention.

However, the target frequency of the dot clock signal may be determined without determining the temporary frequency. That is, as shown in FIG. 7, a dot clock signal generating circuit 14' is employed in place of the PLL circuit 14 to generate a dot clock signal having a predetermined frequency when no frequency division data is inputted. Also, the detection of the screen size by the screen size detecting circuit 17 and the determination of the theoretical resolution by the microcomputer 15 and the table 16 may be performed simultaneously. In this manner, the dot clock signal having the correct frequency can be determined in one step, using the measured resolution, the theoretical resolution and the predetermined frequency.

As described above, according to the present invention, the user does not have to manually adjust blur, color deviation, and fluctuation due to the frequency difference of the dot clock signal. Also, the liquid crystal display apparatus can be automatically adjusted to an optimum display, without using a specific image signal for the adjustment.

What is claimed is:

1. A liquid crystal display apparatus connected to a computer, said liquid crystal display apparatus comprising:

a first processor which detects detected screen size data indicating a screen size for one screen of an image data signal, said first processor evaluating data from a horizontal sync signal, a vertical sync signal, said image data signal and a dot clock signal, wherein said horizontal sync signal, said vertical sync signal and said image data signal are supplied from said computer, said first processor determining said detected screen size by measuring a minimum display start position and a maximum display end position of a screen of said image data signal;

a phase locked loop which generates said dot clock signal from said horizontal sync signal;

a controller which controls said phase locked loop to generate said dot clock signal to have a target frequency based on said detected screen size data, said horizontal sync signal and said vertical sync signal, so that said dot clock signal is adaptive for said computer; and a display including a liquid crystal display unit, which displays said image data signal in response to said dot clock signal having said target frequency.

2. A liquid crystal display apparatus according to claim 1, wherein said controller:

monitors said horizontal sync signal and said vertical sync signal to generate first control data; and generates second control data based on said detected screen size data and said first control data, wherein said phase locked loop generates said dot clock signal having said target frequency based on a combination of said first and said second control data.

3. A liquid crystal display apparatus according to claim 2, wherein said controller includes:

a table for storing a plurality of data sets, each of said data sets representing a relation of a horizontal sync signal frequency, a vertical sync signal frequency, a target dot clock signal frequency and a target resolution; and said controller measures said horizontal sync signal frequency and said vertical sync signal frequency thereby producing measured horizontal and vertical sync frequencies, refers to said table based on said measured horizontal sync signal frequency and said measured vertical sync signal frequency to find a corresponding target frequency, and outputs said first control data corresponding to said target frequency to said phase locked loop.

4. A liquid crystal display apparatus according to claim 3, wherein said controller further calculates a ratio of said target resolution to said detected screen size data and said controller outputs, as said second control data, data obtained by multiplying said ratio and said first control data.

5. A liquid crystal display apparatus according to claim 1, wherein:

said controller further monitors said horizontal sync signal and said vertical sync signal thereby producing a monitoring result, and generates control data based on said detected screen size data and said monitoring result, and wherein said phase locked loop generates said dot clock signal having said target frequency based on said control data.

6. A liquid crystal display apparatus according to claim 5, wherein said controller further includes:

a table which stores a plurality of model data each of which represents a relation of a horizontal sync signal frequency, a vertical sync signal frequency, a target dot clock signal frequency and a target resolution; and said controller measures said horizontal sync signal frequency and said vertical sync signal frequency, refers to said table based on said measured horizontal sync signal frequency and said measured vertical sync signal frequency to obtain said target frequency and said target resolution, calculates a ratio of said target resolution to said detected screen size data, and outputs, as said control data, data obtained by multiplying said ratio by said target frequency.

7. A liquid crystal display apparatus according to claim 1, wherein said first processor comprises:

a counter which counts dot clocks of said dot clock signal for every horizontal scan line of said image data signal;

a signal level comparator which compares said image data signal and a reference signal and produces a comparison result;

a second processor which calculates a dot clock count of said counter corresponding to a display start position for every horizontal scan line based on said comparison result;

a third processor which calculates a dot clock count of said counter corresponding to a display end position for every horizontal scan line based on said comparison result;

a fourth processor which calculates a minimum value of said dot clock counts corresponding to the display start positions for respective horizontal scan lines for one screen of said image data signal;

a fifth processor which calculates a maximum value of said dot clock counts corresponding to the display end positions for respective horizontal scan lines for the one screen of said image data signal; and an output which outputs said minimum value and said maximum value as said detected screen size data to said controller.

8. A method of displaying an image data signal on a liquid crystal display apparatus connected to a computer, said method comprising:

receiving a horizontal sync signal a vertical sync signal and an image data signal from a computer;

generating a dot clock signal from said horizontal sync signal;

detecting detected screen size data indicating a size for one screen of said image data signal from said horizontal sync signal, said vertical sync signal, said image data signal and said dot clock signal, said detecting including measuring a minimum display start position and a maximum display end position of a screen of said image data signal;

changing a frequency of said dot clock signal to a target frequency, based on said detected screen size data, said horizontal sync signal and said vertical sync signal; and displaying said image data signal on said liquid crystal display apparatus in response to said dot clock signal having said target frequency.

9. A method according to claim 8, wherein said changing step includes:

monitoring said horizontal sync signal and said vertical sync signal to generate first control data;

generating said dot clock signal having a first frequency based on said first control data;

generating second control data based on said detected screen size data and said first control data; and generating said dot clock signal having a second frequency as said target frequency based on a combination of said first control data and said second control data.

10. A method according to claim 9, wherein said monitoring step further includes:

providing a table for storing a plurality of data sets, each of said data sets representing a relation of a horizontal sync signal frequency, a vertical sync signal frequency, a target dot clock signal frequency and a target resolution;

measuring said horizontal sync signal frequency and said vertical sync signal frequency to produce a measured horizontal sync frequency and a measured vertical sync frequency;

referring to said table based on said measured horizontal sync signal frequency and said measured vertical sync signal frequency to produce a referring result; and outputting said first control data corresponding to said target frequency based on said referring result.

11. A method according to claim 10, wherein said step of generating second control data includes:

calculating a ratio of said target resolution to said detected screen size data; and outputting, as said second control data, data obtained by multiplying said ratio by said first control data.

12. A method according to claim 8, wherein said changing step includes:

monitoring said horizontal sync signal and said vertical sync signal thereby producing a monitoring result;

generating control data based on said detected screen size data and said monitoring result; and generating said dot clock signal having said target frequency based on said control data.

13. A method according to claim 12, wherein:

said monitoring step further includes:

providing a table for storing a plurality of model data each of which represents a relation of a horizontal sync signal frequency, a vertical sync signal frequency, a target dot clock signal frequency and a target resolution;

measuring said horizontal sync signal frequency and said vertical sync signal frequency thereby producing a measured horizontal sync frequency and a measured vertical sync frequency; and referring to said table based on said measured horizontal sync signal frequency and said measured vertical sync signal frequency to obtain said target dot clock signal frequency and said target resolution, and wherein said step of generating control data includes:

calculating a ratio of said target resolution to said detected screen size data; and outputting, as said control data, data obtained by multiplying said ratio by said target frequency.

14. A method according to claim 8, wherein said detecting includes:

counting dot clocks of said dot clock signal for every horizontal scan line of said image data signal;

comparing said image data signal and a reference signal thereby producing a comparison result;

detecting a dot clock count of said counter corresponding to a display start position for every horizontal scan line based on said comparison result;

detecting a dot clock count of said counter corresponding to a display end position for every horizontal scan line based on said comparison result;

detecting a minimum value of said dot clock counts corresponding to the display start positions for the respective horizontal scan lines for one screen of said image data signal;

detecting a maximum value of said dot clock counts corresponding to the display end positions for the respective horizontal scan lines for one screen of said image data signal; and outputting said minimum value and said maximum value as said detected screen size data.

15. A liquid crystal display apparatus connected to a computer through an interface, said interface comprising:

a first processor which detects detected screen size data indicating a size for one screen of an image data signal from a horizontal sync signal, a vertical sync signal, said image data signal and a dot clock signal, wherein said horizontal sync signal, said vertical sync signal and said image data signal are supplied from said computer, said first processor determining said detected screen size by measuring a minimum display start position and a maximum display end position of a screen of said image data signal;

a phase locked loop which generates said dot clock signal from said horizontal sync signal based on frequency division control data; and a controller which monitors said horizontal sync signal and said vertical sync signal, and generates first control data in response thereto; said controller further generates second control data based on said detected screen size data, and outputs as said frequency division control data, a combination of said first and second control data.

16. A liquid crystal display apparatus according to claim 15, wherein said controller comprises:

a table for storing a plurality of data sets, each of said data sets representing a relation of a horizontal sync signal frequency, a vertical sync signal frequency, a target dot clock signal frequency and a target resolution; wherein said controller measures said horizontal sync signal frequency and said vertical sync signal frequency thereby producing a measured horizontal sync frequency and a measured vertical sync frequency, refers to said table based on said measured horizontal sync signal frequency and said measured vertical sync signal frequency thereby producing a referring result, and outputs said first control data corresponding to said target frequency to said phase locked loop based on said referring result.

17. A liquid crystal display apparatus according to claim 16, wherein said controller further calculates a ratio of said target resolution to said detected screen size data and outputs, as said second control data, data obtained by multiplying said ratio by said first control data.

18. A liquid crystal display apparatus according to claim 15, wherein said first processor comprises:

a counter which counts dot clocks of said dot clock signal for every horizontal scan line of said image data signal;

a signal level comparator which compares said image data signal and a reference signal thereby producing a comparison result;

a second processor which detects a dot clock count of said counter corresponding to a display start position for every horizontal scan line based on said comparison result;

a third processor which detects a dot clock count of said counter corresponding to a display end position for every horizontal scan line based on said comparison result;

a fourth processor which detects a minimum value of said dot clock counts corresponding to the display start positions for respective horizontal scan lines for one screen of said image data signal;

a fifth processor which detects a maximum value of said dot clock counts corresponding to the display end positions for respective horizontal scan lines for one screen of said image data signal; and an output which outputs said minimum value and said maximum value as said detected screen size data to said controller.

19. A liquid crystal display apparatus connected to a computer, said liquid crystal display apparatus comprising:

a first processor which detects detected screen size data indicating a screen size for one screen of an image data signal, said first processor evaluating data from a horizontal sync signal, a vertical sync signal, said image data signal and a dot clock signal, wherein said horizontal sync signal, said vertical sync signal and said image data signal are supplied from said computer;

a phase locked loop which generates said dot clock signal from said horizontal sync signal;

a controller which controls said phase locked loop to generate said dot clock signal to have a target frequency based on said detected screen size data, said horizontal sync signal and said vertical sync signal, such that said dot clock signal is adaptive for said computer;

a display including a liquid crystal display unit, which displays said image data signal in response to said dot clock signal having said target frequency;

said controller monitors said horizontal sync signal and said vertical sync signal to generate first control data;

said controller generates second control data based on said detected screen size data and said first control data, wherein said phase locked loop generates said dot clock signal having said target frequency based on a combination of said first and second control data; and a table for storing a plurality of data sets, each of said data sets representing a relation of a horizontal sync signal frequency, a vertical sync signal frequency, a target dot clock signal frequency and a target resolution, wherein said controller measures said horizontal sync signal frequency and said vertical sync signal frequency thereby producing measured horizontal and vertical sync frequencies, refers to said table based on said measured horizontal sync signal frequency and said measured vertical sync signal frequency to find a corresponding target frequency, and outputs said first control data corresponding to said target frequency to said phase locked loop; wherein said controller further calculates a ratio of said target resolution to said detected screen size data and said controller outputs, as said second control data, data obtained by multiplying said ratio and said first control data.

20. A liquid crystal display apparatus connected to a computer, said liquid crystal display apparatus comprising:

a first processor which detects detected screen size data indicating a screen size for one screen of an image data signal, said first processor evaluating data from a horizontal sync signal, a vertical sync signal, said image data signal and a dot clock signal, wherein said horizontal sync signal, said vertical sync signal and said image data signal are supplied from said computer;

said first processor including a counter which counts dot clocks of said dot clock signal for every horizontal scan line of said image display signal;

a signal level comparator which compares said image data signal and a reference signal and produces a comparison result;

a second processor which calculates a dot clock count of said counter corresponding to a display start position for every horizontal scan line based on said comparison result;

a third processor which calculates a dot clock count of said counter corresponding to a display end position for every horizontal scan line based on said comparison result;

a fourth processor which calculates a minimum value of said dot clock counts corresponding to the display start positions for respective horizontal scan lines for one screen of said image data signal;

a fifth processor which calculates a maximum value of said dot clock counts corresponding to the display end positions for respective horizontal scan lines for the one screen of said image data signal; and an output which outputs said minimum value and said maximum value as detected screen size data to a controller;

a phase locked loop which generates said dot clock signal from said horizontal sync signal;

said controller controls said phase locked loop to generate said dot clock signal to have a target frequency based on said detected screen size data, said horizontal sync signal and said vertical sync signal, so that said dot clock signal is adaptive for said computer; and a display including a liquid crystal display unit, which displays said image data signal in response to said dot clock signal having said target frequency.

21. A method of displaying an image data signal on a liquid crystal display apparatus connected to a computer, said method comprising:

receiving a horizontal sync signal a vertical sync signal and an image data signal from a computer;

generating a dot clock signal from said horizontal sync signal;

detecting detected screen size data indicating a size for one screen of said image data signal from said horizontal sync signal, vertical sync signal, said image data signal and said dot clock signal;

changing a frequency of said dot clock signal to a target frequency, based on said detected screen size data, said horizontal sync signal and said vertical sync signal;

said changing including monitoring said horizontal sync signal and said vertical sync signal to generate first control data;

generating said dot clock signal having a first frequency based on said first control data;

generating second control data based on said detected screen size data and said first control data; and generating said dot clock signal having a second frequency as said target frequency based on a combination of said first control data and said second control data;

said monitoring including providing a table for storing a plurality of data sets, each of said data sets representing a relation of a horizontal sync signal frequency, a vertical sync signal frequency, a target frequency and a target resolution;

measuring said horizontal sync signal frequency and said vertical sync signal frequency to produce a measured horizontal sync frequency and a measured vertical sync frequency;

referring to said table based on said measured horizontal sync signal frequency and said measured vertical sync signal frequency to produce a referring result;

outputting said first control data corresponding to said target frequency based on said referring result;

said generating second control data includes calculating a ratio of said target resolution to said detected screen size data; and outputting, as said second control data, data obtained by multiplying the ratio by said first control data; and displaying said image data signal on said liquid crystal display apparatus in response to said dot clock signal having said target frequency.

22. A method of displaying an image data signal on a liquid crystal display apparatus connected to a computer, said method comprising:

receiving a horizontal sync signal, a vertical sync signal and an image data signal from a computer;

generating a dot clock signal from said horizontal sync signal;

detecting detected screen size data indicating a size for one screen of said image data signal from said horizontal sync signal, said vertical sync signal, said image data signal and said dot clock signal;

said detecting including counting dot clocks of said dot clock signal for every horizontal scan line of said image data signal;

comparing said image data signal and a reference signal thereby producing a comparison result;

detecting a dot clock count of said counter corresponding to a display start position for every horizontal scan line based on said comparison result;

detecting a dot clock count of said counter corresponding to a display end position for every horizontal scan line based on said comparison result;

detecting a minimum value of said dot clock counts corresponding to the display start positions for the respective horizontal scan lines for one screen of said image data signal;

detecting a maximum value of said dot clock counts corresponding to the display end positions for the respective horizontal scan lines for one screen of said image data signal; and outputting said minimum value and said maximum value as said detected screen size data;

changing a frequency of said dot clock signal to a target frequency, based on said detected screen size data, said horizontal sync signal and said vertical sync signal; and displaying said image data signal on said liquid crystal display apparatus in response to said dot clock signal having said target frequency.

23. A liquid crystal display apparatus connected to a computer through an interface, said interface comprising:

a first processor which detects detected screen size data indicating a size for one screen of an image data signal from a horizontal sync signal, a vertical sync signal, said image data signal and a dot clock signal, wherein said horizontal sync signal, said vertical sync signal and said image data signal are supplied from said computer;

a phase locked loop which generates said dot clock signal from said horizontal sync signal based on frequency division control data;

a controller which monitors said horizontal sync signal and said vertical sync signal, and generates first control data in response thereto, said controller further generates second control data based on said detected screen size data, and outputs as said frequency division control data, a combination of said first and second control data; and a table which stores a plurality of data sets, each of said data sets representing a relation of a horizontal sync signal frequency, a vertical sync signal frequency, a target dot clock signal frequency and a target resolution, wherein said controller measures said horizontal sync signal frequency and said vertical sync signal frequency thereby producing a measured horizontal sync frequency and a measured vertical sync frequency, refers to said table based on said measured horizontal sync signal frequency and said measured vertical sync signal frequency thereby producing a referring result, outputs said first control data corresponding to said target frequency to said phase locked loop circuit based on said referring result; calculates a ratio of said target resolution to said detected screen size data and outputs, as said second control data, data obtained by multiplying said ratio by said first control data.

24. A liquid crystal display apparatus connected to a computer through an interface, said interface comprising:

a first processor which detects detected screen size data indicating a size for one screen of an image data signal from a horizontal sync signal, a vertical sync signal, said image data signal and a dot clock signal, wherein said horizontal sync signal, said vertical sync signal and said image data signal are supplied from said computer;

said first processor including, a counter which counts dot clocks of said dot clock signal for every horizontal scan line of said image data signal;

a signal level comparator which compares said image data signal and a reference signal thereby producing a comparison result;

a second processor which detects a dot clock count of said counter corresponding to a display start position for every horizontal scan line based on said comparison result;

a third processor which detects a dot clock count of said counter corresponding to a display end position for every horizontal scan line based on the comparison result;

a fourth processor which detects a minimum value of said dot clock counts corresponding to the display start positions for respective horizontal scan lines for one screen of said image data signal;

a fifth processor which detects a maximum value of said dot clock counts corresponding to the display end positions for respective horizontal scan lines for one screen of said image data signal; and an output which outputs said minimum value and said maximum value as detected screen size data to a controller;

a phase locked loop which generates said dot clock signal from said horizontal sync signal based on frequency division control data; and said controller monitors said horizontal sync signal and said vertical sync signal, and generates first control data in response thereto, said controller further generates second control data based on said detected screen size data, and outputs as said frequency division control data, a combination of said first and second control data.

* * * * *